US012004656B2

(12) United States Patent
Brittingham et al.

(10) Patent No.: US 12,004,656 B2
(45) Date of Patent: Jun. 11, 2024

(54) POWERED SHOP STOOL WITH KNEELING MECHANISM

(71) Applicants: Eric Brittingham, Clarkston, MI (US); Kevin Ferguson, Davisburg, MI (US)

(72) Inventors: Eric Brittingham, Clarkston, MI (US); Kevin Ferguson, Davisburg, MI (US)

( * ) Notice: Subject to any disclaimer, the term of this patent is extended or adjusted under 35 U.S.C. 154(b) by 10 days.

(21) Appl. No.: 17/818,371

(22) Filed: Aug. 9, 2022

(65) Prior Publication Data

US 2023/0048323 A1 Feb. 16, 2023

Related U.S. Application Data

(60) Provisional application No. 63/231,767, filed on Aug. 11, 2021.

(51) Int. Cl.

| | |
|---|---|
| ***A47C 3/20*** | (2006.01) |
| ***A47C 3/30*** | (2006.01) |
| ***A47C 3/36*** | (2006.01) |
| ***A47C 7/00*** | (2006.01) |

(52) U.S. Cl.

CPC ..... *A47C 3/36* (2013.01); *A47C 7/006* (2013.01)

(58) Field of Classification Search

CPC ..... A47C 3/36; A47C 7/006

USPC ..... 297/344.16, 344.17, DIG. 10; 280/32.5

See application file for complete search history.

(56) References Cited

U.S. PATENT DOCUMENTS 3,138,402 A * 6/1964 Heyl, Jr. ..... A61G 5/14 297/DIG. 10
3,596,982 A * 8/1971 Grams ..... A61G 15/02 297/344.17
3,851,917 A * 12/1974 Horstmann ..... A61G 5/14 297/DIG. 10
3,964,786 A * 6/1976 Mashuda ..... A61G 5/006 297/DIG. 10
4,173,372 A * 11/1979 Norris ..... A61G 15/02 297/344.17
4,231,614 A * 11/1980 Shaffer ..... A61G 5/12 297/DIG. 10
4,637,652 A * 1/1987 Bergenwall ..... A47C 1/035 297/DIG. 10
4,637,654 A * 1/1987 Boardman ..... A61G 5/14 297/DIG. 10
4,802,542 A * 2/1989 Houston ..... A61G 5/1051 297/DIG. 10
4,809,804 A * 3/1989 Houston ..... B60L 1/003 297/DIG. 10
4,938,533 A * 7/1990 Thielois ..... A61G 5/14 297/DIG. 10
4,946,222 A * 8/1990 Matson ..... A47C 1/0345 297/DIG. 10
5,155,873 A 10/1992 Bridges
5,611,551 A * 3/1997 Lin ..... B25H 5/00 280/32.5 X (Continued)

FOREIGN PATENT DOCUMENTS

KR 2018084010 A * 7/2018 ..... A47C 3/16
WO WO-8203320 A1 * 10/1982

*Primary Examiner* — Rodney B White

(57) ABSTRACT

A power shop stool that is battery powered and is a personal lifting device. The combination of components leads to a small compact device and allows a worker to adjust the seat height from 6" to 24" from floor lever in a vertical up and down fashion and it has the capability of stopping anywhere in between 6 inches and 24 inches.

8 Claims, 5 Drawing Sheets

(56) References Cited

U.S. PATENT DOCUMENTS 5,772,226 A * 6/1998 Bobichon ..... A61G 5/1054 297/DIG. 10
5,984,411 A * 11/1999 Galumbeck ..... A47C 9/005 297/DIG. 10
6,142,568 A * 11/2000 Abelbeck ..... A61G 5/1059 297/DIG. 10
6,154,896 A * 12/2000 Houston ..... A61G 7/1094 297/DIG. 10
6,169,735 B1 1/2001 Allen, Jr.
6,189,164 B1 * 2/2001 Krapu ..... A61G 7/1094 297/DIG. 10
6,213,554 B1 * 4/2001 Marcoux ..... A61G 5/14 297/DIG. 10
6,507,961 B1 * 1/2003 Ming-Hwa ..... A61G 5/14 297/DIG. 10
6,619,735 B1 * 9/2003 Ming-Hwa ..... A61G 7/1017 297/DIG. 10
7,021,713 B2 * 4/2006 Kao ..... A61G 5/14 297/DIG. 10
7,341,310 B1 * 3/2008 Ross ..... A47C 3/36 297/344.17
7,516,977 B2 * 4/2009 Wu ..... A61G 5/045 297/344.17 X
D608,558 S 1/2010 Rush
7,819,476 B2 * 10/2010 Gong ..... A61G 5/14 297/344.17 X
7,887,133 B2 * 2/2011 Perk ..... A61G 5/10 297/DIG. 10
7,954,577 B2 * 6/2011 Wang ..... A61G 5/045 280/755
8,056,158 B2 * 11/2011 Henshaw ..... A61G 7/1007 297/DIG. 10
8,104,835 B2 * 1/2012 Ovre ..... A61G 5/127 297/DIG. 10
8,556,347 B2 * 10/2013 Lin ..... A61G 5/14 297/DIG. 10
8,562,007 B2 * 10/2013 Menichini ..... A61H 3/04 280/87.041
8,973,926 B1 3/2015 Lensing
8,973,997 B2 * 3/2015 Green ..... A61G 5/1067 297/DIG. 10
10,045,895 B2 * 8/2018 Eklof ..... A61G 7/1046
10,932,972 B1 * 3/2021 Bennett ..... A61G 7/1007
2007/0029854 A1 * 2/2007 Robinson ..... B60N 2/502 297/344.17
2015/0366729 A1 * 12/2015 Quick ..... A47C 3/20 297/344.17 X

* cited by examiner

POWERED SHOP STOOL WITH KNEELING MECHANISM

CROSS-REFERENCE TO RELATED APPLICATIONS

This application is a utility patent application based on U.S. Provisional patent application Ser. No. 63/231,767, filed Aug. 11, 2021 from which priority is claimed.

STATEMENT REGARDING FEDERALLY SPONSORED RESEARCH OR DEVELOPMENT

Not Applicable.

REFERENCE TO SEQUENCE LISTING, A TABLE, OR A COMPUTER PROGRAM LISTING COMPACT DISC APPENDIX

Not Applicable.

BACKGROUND OF THE INVENTION

The object of this invention is a power shop stool that is battery powered and is a personal lifting device. The unique combination of components leads to a small compact device and allows a worker to adjust the seat height from less than 6" to more than 24" from floor lever in a vertical up and down fashion and it has the capability of stopping anywhere in between.

Adjustable seats and or stools are known in the art. For example, U.S. Pat. No. 5,155,873 that issued to Bridges on Oct. 20, 1992, deals with a lift stool for use in conjunction with a removable pot or a stationary toilet bowl in which the device depends, in part, on the substrate over which it is positioned to provide some support for the device. It is noted that it operates with an actuator, but the actuator only works on one side of the device, and it has a large pot or bowl associated with it. It is also noted that there are no safety switches, in that, one may pinch or lose fingers in the operation of the device.

U.S. Pat. No. 6,507,961 that issued Jan. 21, 2003, to Ming-Hwa deals with an elevating mechanism for assisting patients in using a toilet. The device is not portable, that is, does not have any wheels or other mechanism to allow it to be moved without actually lifting the device and carrying it.

U.S. Pat. No. 6,619,735 that issued to Ming-Hwa on Sep. 16, 2003, deals with a power-actuated chair-type elevating apparatus for moving persons from one site to another. The elevating apparatus would not allow this device to come closed to the floor and thus is limited in its use.

A patent, U.S. design 608,558, issued to Rush on Jan. 26, 2010, and it deals with a mechanic's shop stool. It appears to operate from a centralized piston mechanism.

U.S. Pat. No. 8,973,926, that issued on Mar. 10, 2015, to Lensing, deals with a mechanic's shop stool that appears to operate from a centralized piston mechanism.

None of these prior art publications describe or make obvious the instant invention.

BRIEF SUMMARY OF THE INVENTION

The instant invention is a power shop stool that is battery powered and is a personal lifting device. The unique combination of components leads to a small compact device and allows a worker to adjust the seat height from 6" to 24" from floor lever in a vertical up and down fashion and it has the capability of stopping anywhere in between 6 inches and 24 inches.

BRIEF DESCRIPTION OF THE SEVERAL VIEWS OF THE DRAWING(S)

DETAILED DESCRIPTION OF THE INVENTION AND DRAWINGS

Figure 1:
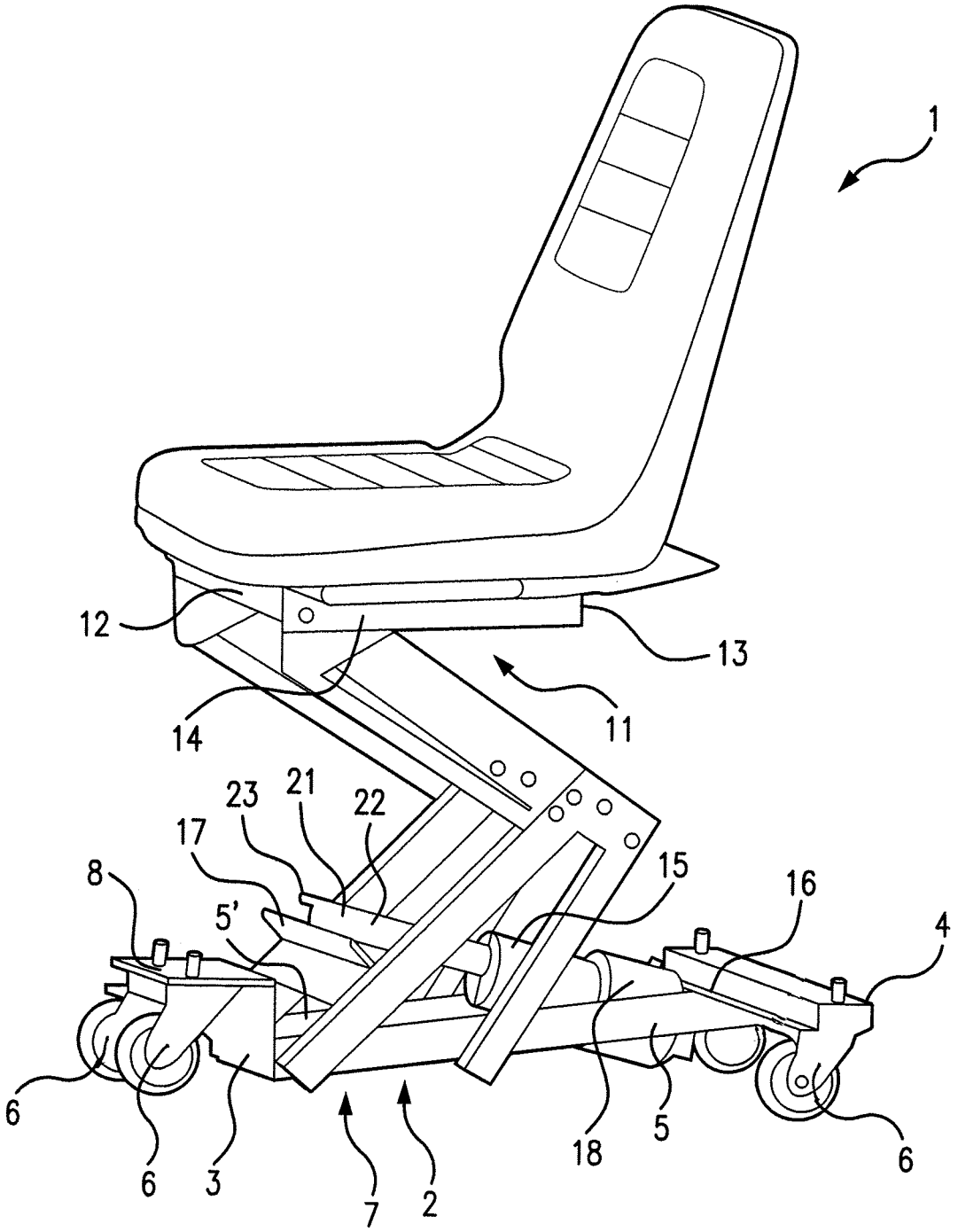
FIG. 1 is a view in perspective of a device of this invention.

Turning now to FIG. 1 there is shown in a side perspective, a device 1 of this invention. There is a main support frame 2 having a front end 3, a back end 4, and two parallel side bars 5 and 5'. The main support frame 2 has a plurality of legs 6 that are attached on a bottom 7 of the main support frame 2. At least two of the legs 6 are mounted directly on the main support frame 2 and at least two legs 6 are mounted on a front toe support 8. For purposes of this invention, the front toe support is a shelf that is configured such that it is higher that the main support frame 2 but is securely attached to the main support frame 2. If casters 6 are used, the casters 6 are 360-degree full swivel so that the device 1 can be moved in any direction during use. The main support frame 2 has a front axle 9 mounted between the parallel side bars 5 and 5'.

At the top 10 of the device 1 there is an upper seat frame 11 having a front 12, a back 13, and two parallel side rails 14 and 14' with two side shelves 10 and 10' attached thereto. The shelves 10 and 10' can be of solid construction or can be collapsible such that they will close against the side rails 13 and 14' of the upper seat frame 9.

There is an actuator 15 for raising and lowering the upper seat frame 11, the actuator 15 is rotatably mounted on the back 4 of the main support frame 2 and the opposite end 16 of the actuator 15 is rotatably mounted to an actuator plate 17. The actuator plate 17 is mounted on the front axle 9 which allows for a partial rotation of the connections of an actuator 15 during the raising and lowering of the upper seat frame 11. The actuator 15 for purposes of illustration is shown in FIG. 1 as an electrical hydraulic linear actuator. Other types of actuators can be used in this invention, for example ball screws, air cylinders, hand pumps and the like.

The actuator 15 is powered by a motor 18 which motor 18 is energized by an electrical connection (shown in FIG. 1) to a battery 19 that is located behind a seat (discussed infra). The motor has an 18 to 28 volt capacity in order to move the loaded device 1. The battery 19 also energizes the control switches 20 (detailed infra) which are electrically connected (not shown in FIG. 1). The actuator 15 has a piston rod 21 and there is a die spring 22 surrounding the piston rod 21. Leads 23 for the electrically energizing the actuator 15 can be found in FIG. 1.

Figure 2:
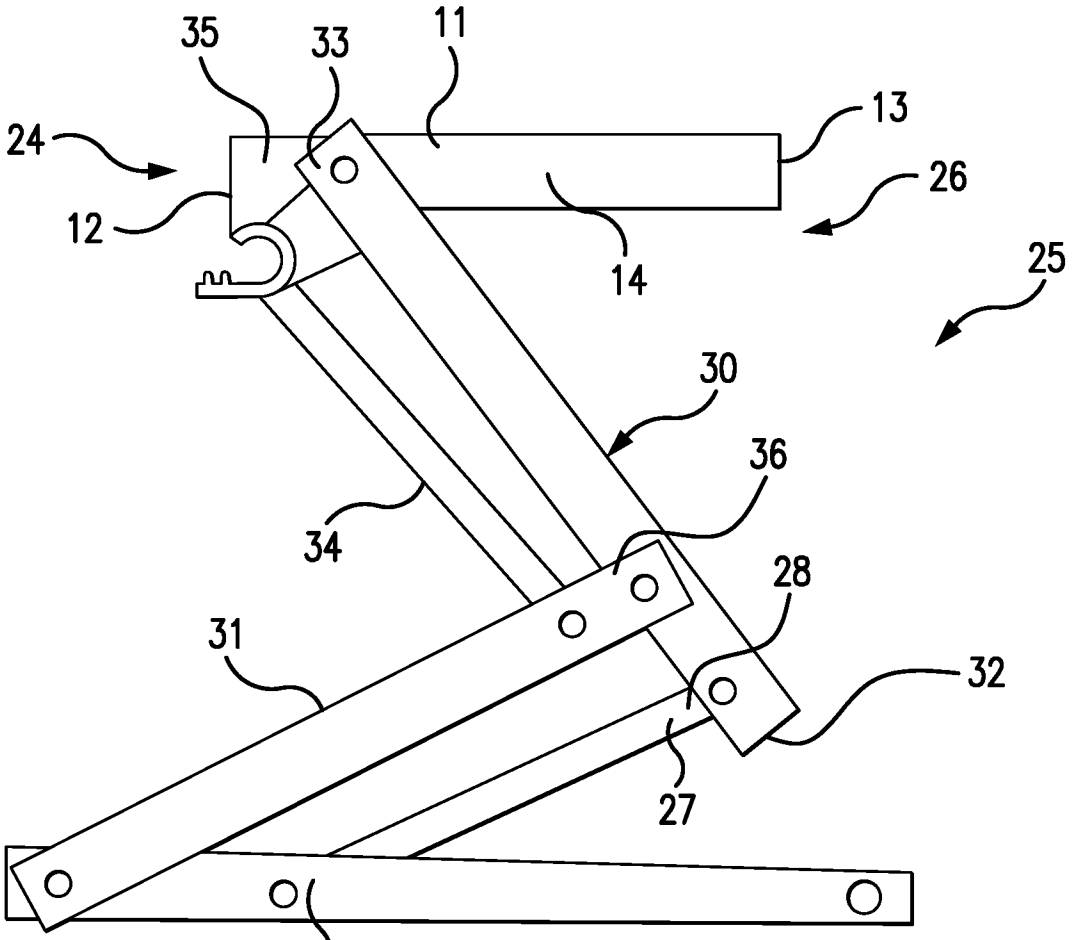
FIG. 2 is full side view of the lifting apparatus of the instant invention.
Figure 3:
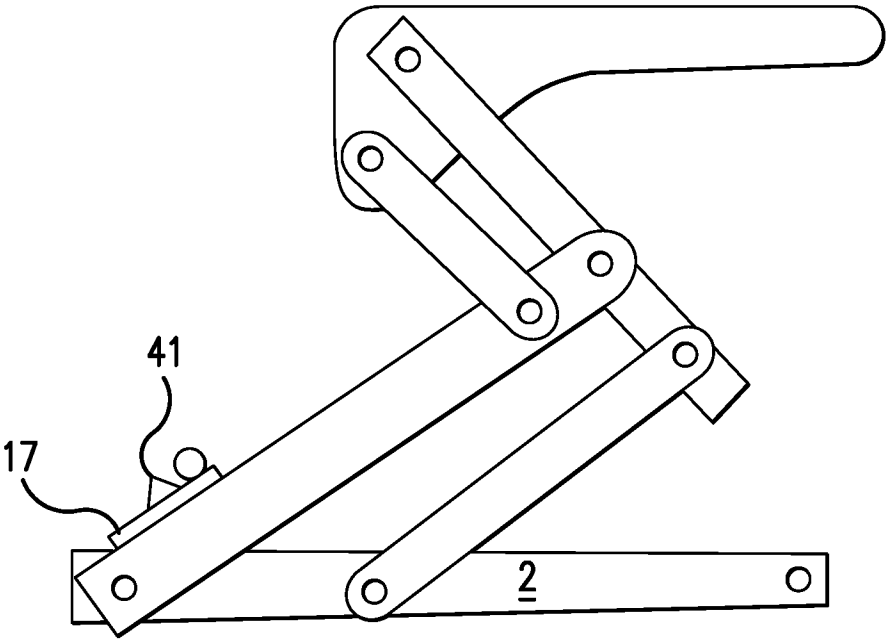
FIG. 3 is a full side view of the lifting device of this invention showing the toe plate mounting.

Turning now to FIG. 2, there is shown a full side view of the articulatable lifting apparatus 25 of the instant invention. For purposes of this invention, by "articulatable lifting apparatus" it is meant the device of this invention having the described "kneeling mechanism". The device 1 of this invention has two, side by side lifting apparatus 25 (the "kneeling mechanism"). They are parallel to each other and spaced apart about the width of the main support frame 2, that is, there is a left side and a right side, and a front 24 and a back 26. They each consist of a lower tension arm 27 rotatably mounted at a near end 28 to the main support frame 2 and at a distal end 29 to an upper leg member 30. A lower leg member 31 is rotatably mounted to the main support frame 2 by a near end 32 and to a distal end 33 of an upper leg member 30.

An upper tension arm 34 is rotatably mounted to the upper seat frame 11 at a near end 35 of the upper seat frame 11 and near the distal end 36 of said lower leg 31 such that when actuated, said articulatable support assemblies 25 move the upper seat frame 11 in a vertical up or down motion.

Figure 4:
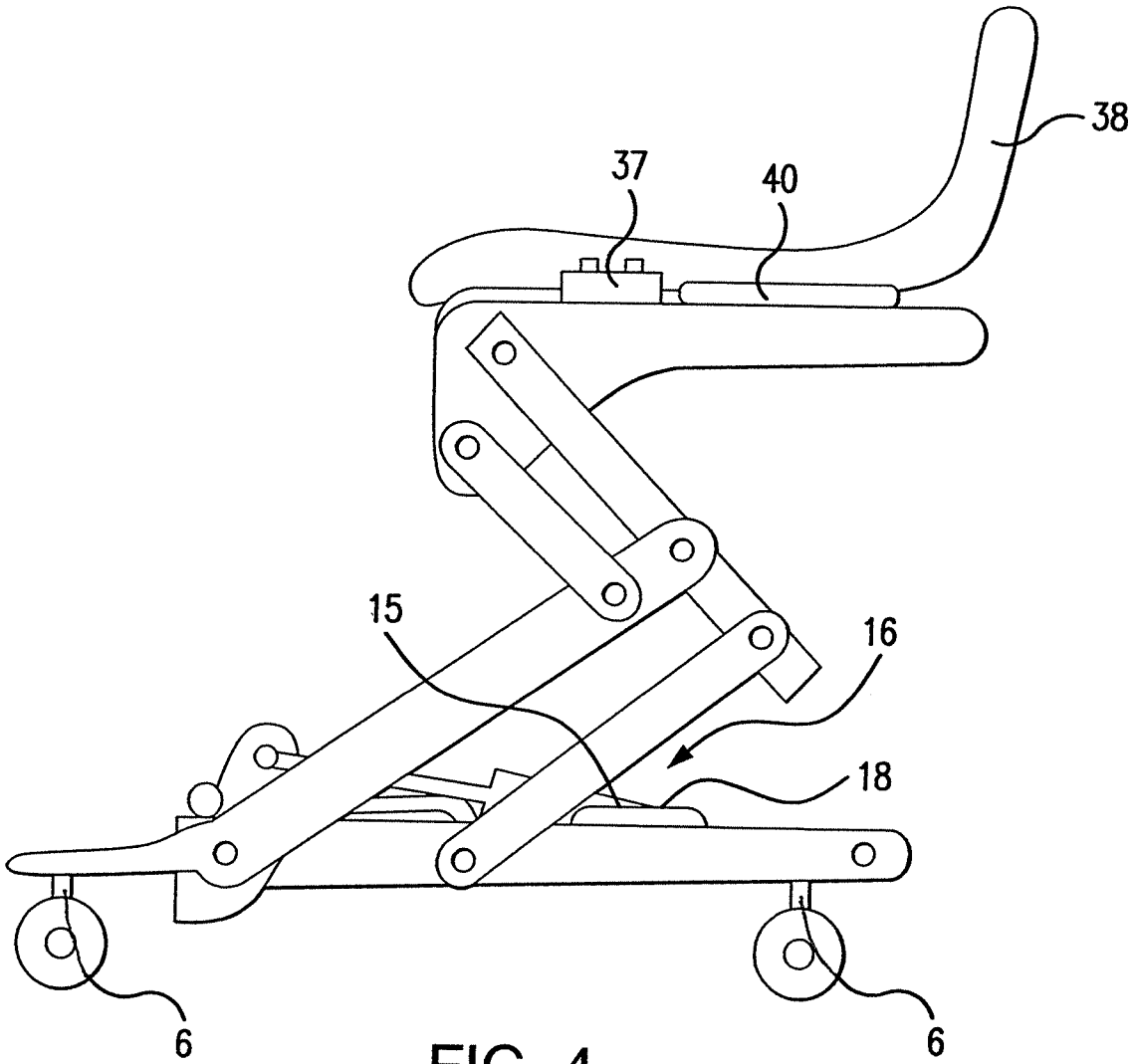
FIG. 4 is a full side view of this invention showing the mounting of the seat, the actuator, the motor, and the control buttons along with a side shelf.

The control mechanism 20 referred—to Supra includes dual control members 37 in which one such member is shown in FIG. 4. There is an identical control button 37 on the opposite side of the seat 38 also shown in FIG. 4. The control button 37 are configured such that both up buttons and both down buttons have to be touched at the same time in order to move the lifting apparatus 25. In addition, there are small wells 39 (shown in FIG. 5 in phantom) beside the control buttons 37 in which the user's hands will fit. This means of control is a safety factor in that neither hand can go under or around the moving mechanism because both hands need to stay in the wells 39 and on the control buttons 37 to operate the mechanism.

Figure 5:
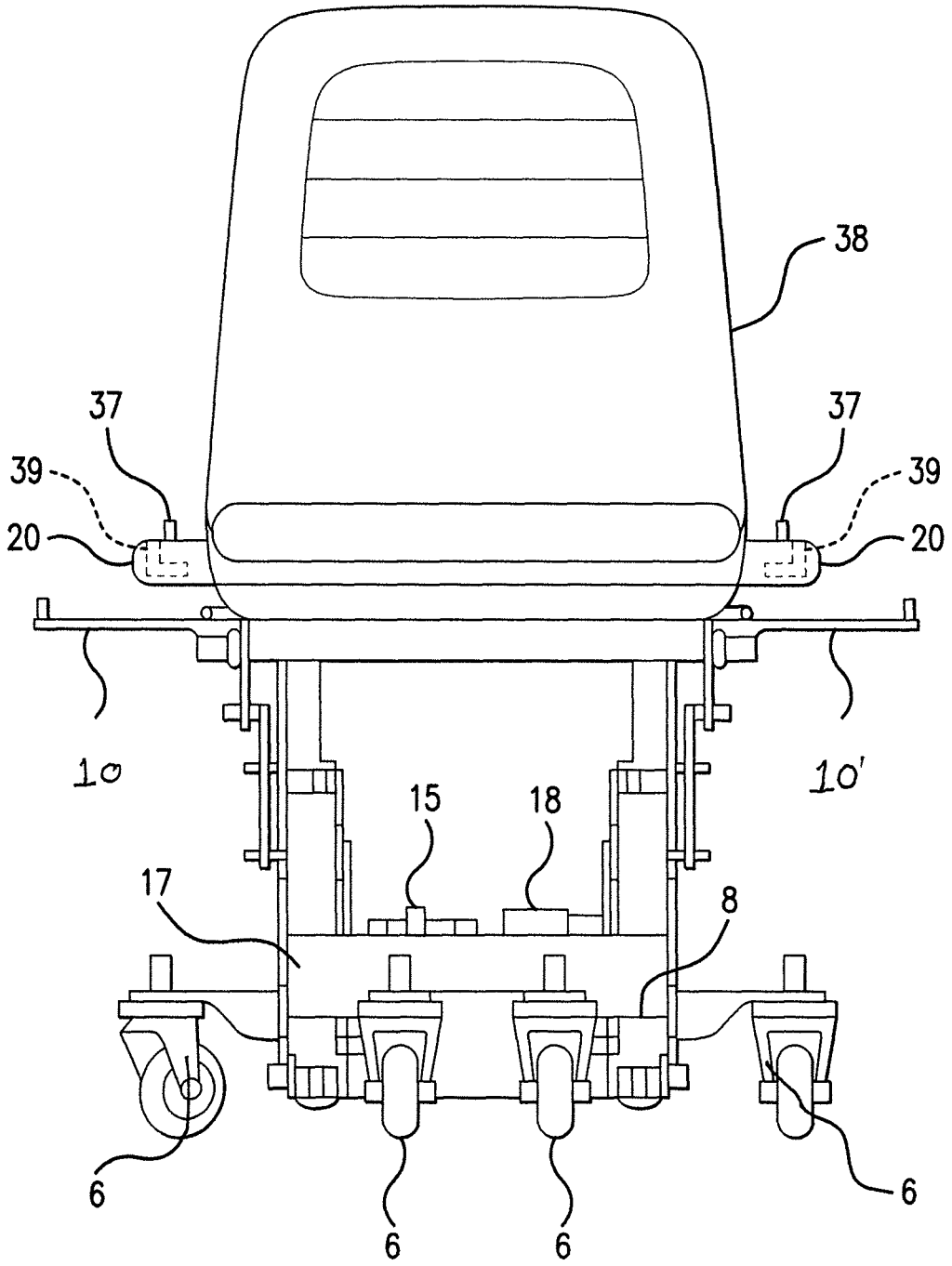
FIG. 5 is a full front view of the device of this invention.

The shelfs 40 alluded to Supra are also shown in FIG. 5.

The devices of this invention are small, compact and allow the worker to adjust the heat height. Powered by an actuator, and in certain cases a battery, the operation is able to adjust the height of the stool to less than 6 inches from the floor to over 24 inches higher in a vertical fashion and can stop anywhere in between.

The kneeling mechanism (crouching action) tension arms transfer the seat load to the upper arms of the device to reduce radial loads on the actuator. The tension arms pivot around the knee pins used to make the connections of the lifting apparatus 25 in such a manner to keep the seat parallel to the floor throughout the entire range of motion. The lower tension arm attachment points are cantilevered from the knee joint. The kneeling design allows open clearance area beneath the user. The mechanism is designed to occupy the same amount of floor space as the user. The control arms under tension cause the upper and lower legs to hinge at their meeting points like a human knee, and the legs to operate in a crouching action. The dual hand controls are safety oriented to reduce likelihood of hand injuries in using the mechanism. The U-shaped lower frame section is to reduce racking. A four-wheeled design can be used for enhancing off-axis stability of the device. The device raises and lowers using a unique kneeling mechanism featuring tension arms to eliminate the cross bars found on conventional scissor mechanisms. The kneeling mechanism allows the device to move closer to the floor to access work at that level.

What is claimed is:

1. A powered shop stool having a vertical working distance of from 6 inches to about 24 inches from a floor surface, said powered shop stool comprising:

A) a main support frame having a front end, a back end, and two parallel side bars, said main support frame having four legs attached on a bottom of said main support frame, at least two of said legs mounted directly on said main support frame and at least two legs mounted on a front toe support; said main support frame having a front axle mounted between said parallel side bars;

B) an upper seat frame having two side shelves;

C) an actuator for raising and lowering an upper seat frame, said actuator being rotatably mounted on said back of said main support frame, an opposite end of said actuator being mounted to an actuator plate, said actuator plate being mounted on said front axle, said actuator having a piston rod and a tension spring surrounding said piston rod;

D) a motor for driving said actuator, said motor being mounted on a side of said main support frame;

E) a battery for energizing said motor and, electrical connections between said battery and said motor, and F) duplicate tandem controls for said motor mounted on said side shelves;

G) a pair of left and right parallel articulatable support assemblies, each said assembly comprising:

i) a lower tension arm rotatably mounted at a first end to said main support frame and rotatably mounted at a second end to a first end of an upper leg member and, a lower leg member, a first end of said lower leg member rotatably mounted to a first end of said main support frame at a first end of said main support frame and a second end of said lower leg member rotatably mounted near said second upper leg;

ii) an upper tension arm rotatably mounted to a first end of said upper seat frame and rotatably mounted near said second distal end of said lower leg, such that when actuated, said articulatable support assemblies move said upper seat frame in a vertical up or down motion.

2. A powered shop stool as claimed in claim 1 wherein there is a seat mounted on said upper seat frame.

3. A powered shop stool as claimed in claim 1 wherein said actuator is an electro-hydraulic linear actuator.

4. A powered shop stool as claimed in claim 1 wherein said actuator is a ball screw apparatus.

5. A powered shop stool as claimed in claim 1 wherein said actuator is an air cylinder.

6. A powered shop stool as claimed in claim 1 wherein said actuator is a hand pump.

7. A powered shop stool as claimed in claim 1 wherein said legs contain free rolling swivel casters.

8. A powered shop stool as claimed in claim 1 wherein said legs are crawler tracks.

* * * * *